United States Patent [19]

Nagel

[11] 4,400,853

[45] Aug. 30, 1983

[54] NEEDLE BAR DRAWING DEVICE

[75] Inventor: Jens Nagel, Mölln, Fed. Rep. of Germany

[73] Assignee: Nordischer Maschinenbau Rud. Baader GmbH+Co. KG, Lubeck, Fed. Rep. of Germany

[21] Appl. No.: 307,795

[22] Filed: Oct. 2, 1981

[30] Foreign Application Priority Data

Oct. 3, 1980 [DE] Fed. Rep. of Germany ..... 3037445

[51] Int. Cl.[3] ..... D01H 5/02

[52] U.S. Cl. ..... 19/129 R

[58] Field of Search ..... 19/129 R, 129 A

[56] References Cited

U.S. PATENT DOCUMENTS

| | | | |
|---|---|---|---|
| 1,784,140 | 12/1930 | Hadfield et al. | 19/129 R |
| 2,130,599 | 9/1938 | Redman | 19/129 R |
| 2,392,709 | 1/1946 | Jagt | 19/129 R |
| 2,406,642 | 8/1946 | Signoret | 19/129 R |
| 3,626,552 | 12/1971 | Walker et al. | 19/129 R |

FOREIGN PATENT DOCUMENTS

| | | | |
|---|---|---|---|
| 506707 | 6/1929 | Fed. Rep. of Germany | 19/129 R |
| 611914 | 11/1932 | Fed. Rep. of Germany | 19/129 R |
| 1760656 | 11/1970 | Fed. Rep. of Germany | 19/129 A |
| 7426839 | 10/1975 | Fed. Rep. of Germany | . |
| 471909 | 6/1969 | Switzerland | 19/129 R |
| 180121 | 6/1966 | U.S.S.R. | 19/129 R |

*Primary Examiner*—Louis Rimrodt

*Attorney, Agent, or Firm*—Edward F. Levy

[57] ABSTRACT

In an needle bar drawing device or gill box comprising needle bars carried by chains is arranged a bristle mat consisting of one or few layers of bristles extending along the whole needle field up to the proximity of a clamping gap formed between a pair of exit rollers. The bristle mat is penetrated by the needles of the needle field and creates a stripping effect at the disappearing position of the needles in the region of the nip, this stripping effect avoiding the conveying of fibers freely swimming in the sliver, and thus the danger and disadvantage of any lap forming.

5 Claims, 2 Drawing Figures

1
2
3
4
5
6
7
8
9
10
11
12
13/14
15
16
17
18
19
20
21
22
2
2

NEEDLE BAR DRAWING DEVICE

BACKGROUND OF THE INVENTION

1. Field of the Invention

The invention relates to a needle bar drawing device or gill box for slivers comprising a needle field or gill area of needle bars carried by chains and means for holding down the slivers arranged opposite said needle field, which is arranged between one pair each of entrance and exit rollers, respectively.

2. Description of Prior Art

Such gill boxes are preferably used in processing longstaple spinning material, the lacking upper needle field being substituted by hold down means in the form of slubbing rollers, bar chains or the like. Such structure is essentially preferable in contrast to known double needle bar drawing devices in that the expenses for the construction are lower and it is possible to adjust the nip which is very closely similar to that achievable in spindle driven gill boxes (faller bar devices). The disadvantage of such structure lies in the relatively restricted applicability. In trying to extend the possibilities of application of this construction which, due to the simplicity of its structure, is little susceptible to failure to the production of worsted or mock-worsted material, the meshing conditions were, as e.g. can be taken from DE-GM 74 26 839, adapted to those of double needle bar devices by providing the single needle bars with two needle rows each so that a gill area of a narrower resp. finer needle spacing was achieved. It was found out, however, that the tendency towards lap formation or licking on the exit roller increases considerably, particularly where the spinning material to be treated comprises a large portion of short fibres. This leads to an increased portion of freely-swimming fibres between the needle field and the exit rollers, that is in the so-called nip, which fibres will no longer be carried resp. conveyed safely. The reason for the lap formation resides in that the simultaneous disappearing of two needle rows at the end of the needle field leads to an increased friction between the single fibres and the needles due to the narrow needle division. This phenomenon will also be observed in needle fields with single needle rows of a very fine needle spacing.

3. Object of the Invention

It is therefore a main object of the invention to adapt single row needle bar drawing devices in such a manner that they are suitable for treating short staple or short-fibred spinning material.

BRIEF SUMMARY OF THE INVENTION

This object is solved in accordance with the present invention in a gill box for slivers of the known structure described in the first paragraph under "Field of the Invention" in that a bristle mat is arranged to extend over at least part of the lateral extension of the needle field and to be penetrated by the needles, the bristle mat comprising at least one layer of bristles, which extend flatly and in the moving direction and a moving plane of the needle bars, lie closely adjacent each other, are arranged essentially parallel to each other and extend over essentially the whole length of said needle field up to the proximity of the clamping gap formed by the exit rollers.

The advantages achieved thereby reside, in particular, in that the sliver is supported immediately up to the clamping gap of the exit rollers, the flatly positioned bristles acting as stripping elements with respect to the needles dipping away at the disappearing position.

Preferably, the bristles of the bristle mat may be held in the region between the entrance rollers and the emerging position of the needle bars into the drawing plane. The holding of the bristles may be performed by means of a holding device, which is adjustable at least in the longitudinal direction of the drawing plane, so that it is possible to adjust precisely the ends of the bristles up to the immediate proximity of the clamping gap of the exit rollers.

In order to increase the tensile strength of the bristles, these may advantageously have a cross section which is noncircular, i.e., differs from the circular shape, and is preferably elliptic. In this case the holding of the bristles may be performed such that the longer cross sectional axis is orientated essentially perpendicular with respect to the drawing plane.

The means for holding down the sliver may expediently cover the whole gill area and consist of a bristle field arranged opposite to the needle field, the bristles of said bristle field being arranged at an inclination in the moving direction of the needle field to project into the latter. By such an arrangement, a further simplification and improvement of the working and operational reliability may be achieved.

BRIEF DESCRIPTION OF THE DRAWINGS

Other and further objects of the present invention will be apparent from the following description and claims and are illustrated in the accompanying schematic drawing, which, by way of illustration, shows a preferred embodiment of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims.

In the drawings.

DETAILED DESCRIPTION OF THE PREFERRED EMBODIMENT

Figures 1, 2:
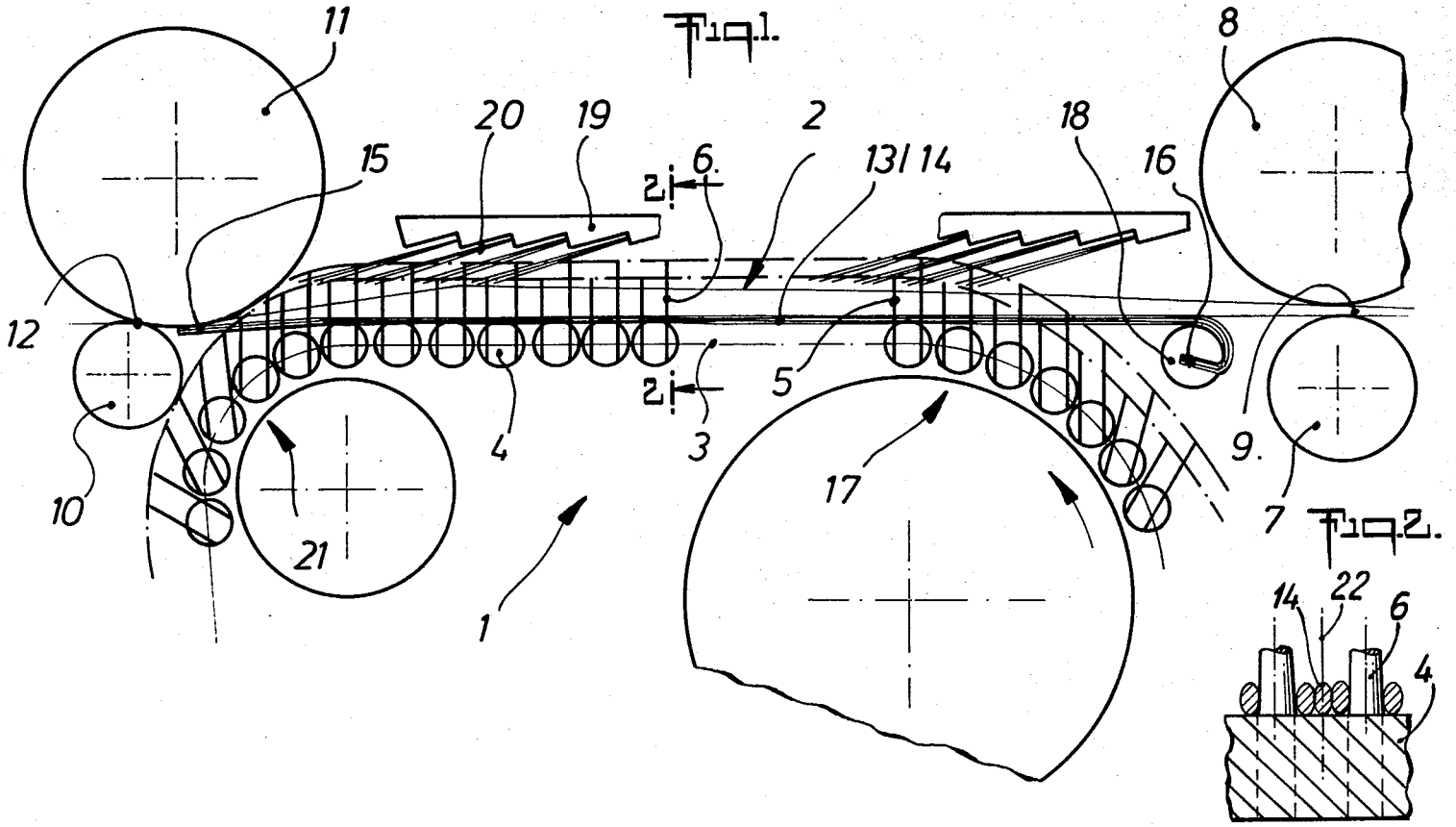
FIG. 1 shows a schematic cross sectional view of a needle bar drawing device in accordance with the invention.
FIG. 2 is an enlarged sectional view taken along line 2—2 of FIG. 1 and showing a preferred cross-sectional configuration of the bristles of the needle bar drawing device.

In a non-shown frame of a needle bar drawing device or gill box 1 a needle field 2 is arranged. This needle field is formed by needle bars 4 carried by chains 3. Each of the needle bars 4 is provided with two rows of needles 5, 6 having different lengths, the shorter needles 5 leading the longer needles 6. In front of the needle field 2 there is provided a pair of entrance rollers, which comprise a lower roller 7 and a spring biased upper roller 8. These rollers are arranged such that a clamping position or gap 9 defined by them lies approximately in the plane of the upper edges of the needle bars 4. Behind the needle field 2 there is provided a pair of exit rollers comprising a lower roller 10 and a spring biased upper roller 11, which are arranged such that they define a clamping position or gap 12 which is also situated approximately in the plane of the upper edges of the needle bars 4 and that the tips of the needles 5 and 6 may be guided past their periphery at a minimum distance. A bristle mat 13 extends over the total width of the needle field 2 between the pairs of entrance rollers and exit rollers. This bristle mat 13 comprises a few layers of bristles 14, which layers are arranged above each other. The bristles 14 have free ends 15 which are guided up to the proximity of the clamping gap 12 of the pair of exit rollers 10, 11, while their other ends 16 are fixed to a holder 18 which is arranged in the region between an emerging position 17 of the needle bars 4 and the pair of entrance rollers 8, 9. The bristles 14 may be made of synthetic material as for example polyamide or polyester or of metallic or mineral material. Their cross sectional shape is not limited to a circular shape. In order to increase the tensile strength it may e.g. be elliptic. In this case, the holding is performed such that the longer one of the two cross sectional axes is orientated perpendicularly to the drawing plane of the needle field 2. In order to be able to adjust the distance of the free ends 15 of the bristles 14 with respect to the clamping gap 12, the holder 18 is arranged pivotally and may be fixed in its adjusted position. Hold down means 19, which are formed bristle-like, are arranged above the needle field 2. Bristles 20 of these hold down means 19 penetrate a little into the needle field 2.

FIG. 2 shows, by way of example, a cross-sectional view of the bristles 14 which have an elliptical cross-sectional shape. The longer or major axis 22 of bristle 14 is arranged perpendicularly to the drawing plane of the needle field 2.

The effective mechanism and function of the described device is based on the elasticity of the bristles 14 of the bristle mat 13 to the effect that the free ends 15 of the bristles 14 support the spinning material when guiding it in the space between the disappearing position of the needles 5, 6 from the sliver and the clamping gap 12, which space is also termed "nip". The free ends 15 of the bristles 14 may lie on the periphery of the lower roller 10 of the pair of exit rollers 10, 11, so that the friction occurring between the needles 5, 6 and the bristles does not effect a conveying of the layer towards the deflection position, and that thus the stripping function may become effective safely.

What I claim as my invention and seek to secure by Letters Patent is:

1. Needle bar drawing device or gill box for slivers comprising needle field or gill area means defining a drawing plane and including a plurality of needle bars each carried by chain means to move said needle bars in a moving direction and a moving plane and each comprising a plurality of needles, and hold down means for holding down said slivers, said hold down means being arranged opposite said needle field means positioned between entrance and exit roller means, respectively, said exit roller means defining a clamping gap for said sliver, wherein bristle mat means are arranged to extend over at least part of the lateral extension of said needle field means and to be penetrated by said needles, said bristle mat means comprising at least one layer of bristles, which extend flatly in said moving direction and moving plane of said needle bars, lie closely adjacent to each other, are arranged approximately parallel to each other and extend over essentially the whole length of said needle field means up to the proximity of said clamping gap.

2. Needle bar drawing device or gill box for slivers comprising needle field or gill area means defining a drawing plane and including a plurality of needle bar means, each of which is carried by chain means to move said needle bars in a moving direction and a moving plane forming part of an endless path and comprises a plurality of needles, said device further comprising hold down means for holding down said slivers, said hold down means being arranged opposite said needle field means positioned between entrance and exit roller means, respectively, said exit roller means defining a clamping gap for said sliver and said needle bar means moving between an emerging position and a disappearing position both forming part of said endless path to define said gill area means and lying between said entrance and exit roller means, wherein bristle mat means are arranged to extend over at least part of the lateral extension of said needle field means and to be penetrated by said needles, said bristle mat means comprising at least one layer of bristles which bristles extend flatly in said moving direction and moving plane of said needle bars, lie closely adjacent to each other, are arranged approximately parallel to each other, extend over essentially the whole length of said needle field means up to the proximity of said clamping gap, and are held in a region between said entrance rollers and said emerging position of said needle bars into said drawing plane by holding means which are adjustable at least in the longitudinal direction of said drawing plane.

3. Needle bar drawing device as claimed in claim 1 or 2, wherein said bristles have a non-circular, preferably elliptic cross section, said holding means providing for an approximately perpendicular orientation of their longer cross sectional axis with respect to said drawing plane.

4. Needle bar drawing device as claimed in claim 2 wherein said hold down means cover at least the area of said emerging position and of said disappearing position of said needle bars.

5. Needle bar drawing device as claimed in claim 1 or 2 wherein said hold down means comprise a bristle field arranged opposite said needle field, the bristles of said bristle field being inclined in said moving direction to extend into said needle field means.

* * * * *